US010168078B2

(12) United States Patent
Nakamura et al.

(10) Patent No.: US 10,168,078 B2
(45) Date of Patent: Jan. 1, 2019

(54) REFRIGERATION SYSTEM

(71) Applicant: MAYEKAWA MFG. CO., LTD., Tokyo (JP)

(72) Inventors: Naoko Nakamura, Tokyo (JP); Shunsuke Komatsu, Tokyo (JP); Shota Ueda, Tokyo (JP); Masao Komeda, Tokyo (JP); Mizuo Kudo, Tokyo (JP); Akito Machida, Tokyo (JP)

(73) Assignee: MAYEKAWA MFG. CO., LTD., Tokyo (JP)

( * ) Notice: Subject to any disclaimer, the term of this patent is extended or adjusted under 35 U.S.C. 154(b) by 202 days.

(21) Appl. No.: 14/888,235

(22) PCT Filed: Mar. 20, 2014

(86) PCT No.: PCT/JP2014/057678
§ 371 (c)(1),
(2) Date: Oct. 30, 2015

(87) PCT Pub. No.: WO2014/178240
PCT Pub. Date: Nov. 6, 2014

(65) Prior Publication Data

US 2016/0076793 A1 Mar. 17, 2016

(30) Foreign Application Priority Data

May 2, 2013 (JP) ..... 2013-097143

(51) Int. Cl.
*F25B 7/00* (2006.01)
*F25B 9/06* (2006.01)
(Continued)

(52) U.S. Cl.
CPC ..... *F25B 9/06* (2013.01); *F25B 1/10* (2013.01); *F25B 6/04* (2013.01); *F25B 11/02* (2013.01);
(Continued)

(58) Field of Classification Search
CPC ..... F25B 9/06; F25B 1/10; F25B 6/04; F25B 11/02; F25B 27/00; F25B 25/005;
(Continued)

(56) References Cited

U.S. PATENT DOCUMENTS 2,737,031 A * 3/1956 Wulle ..... F25B 1/10 62/271
3,668,884 A 6/1972 Nebgen
(Continued)

FOREIGN PATENT DOCUMENTS

DE 2122064 A1 12/1971
EP 1772686 A2 4/2007
(Continued)

OTHER PUBLICATIONS

Extended European Search Report issued in European Appln. No. 14791203.4, dated Nov. 22, 2016.
(Continued)

*Primary Examiner* — Joseph Trpisovsky
(74) *Attorney, Agent, or Firm* — Rossi, Kimms & McDowell LLP

(57) ABSTRACT

To provide a refrigeration system capable of being installed efficiently in a limited space while ensuring a good reliability, the refrigeration system according to the present invention comprises a refrigeration cycle having: a circulation path (101) in which a refrigerant flows; and at least one compressor (102) for compressing the refrigerant, a heat exchanger (103) for cooling the refrigerant compressed by the compressor, at least one expansion turbine (104) for expanding the refrigerant cooled by the heat exchanger to generate cold heat, and a cooling part (105) for cooling an object to be cooled by the cold heat, which are provided on the circulation path in order, wherein at least either the at least one compressor or the at least one expansion turbine
(Continued)

comprises a plurality of compressors or expansion turbines which are arranged in parallel with one another with respect to the circulation path.

6 Claims, 5 Drawing Sheets

(51) Int. Cl.

| | |
|---|---|
| ***F25B 1/10*** | (2006.01) |
| ***F25B 11/02*** | (2006.01) |
| ***F25B 27/00*** | (2006.01) |
| ***F25B 6/04*** | (2006.01) |
| *F25B 25/00* | (2006.01) |
| *F25B 41/04* | (2006.01) |

(52) U.S. Cl.
CPC ..... *F25B 27/00* (2013.01); *F25B 25/005* (2013.01); *F25B 41/04* (2013.01); *F25B 2339/047* (2013.01); *F25B 2400/072* (2013.01); *F25B 2400/075* (2013.01); *F25B 2400/14* (2013.01)

(58) Field of Classification Search
CPC ..... F25B 41/04; F25B 2339/047; F25B 2400/072; F25B 2400/075; F25B 2400/14
USPC ..... 62/335, 175
See application file for complete search history.

(56) References Cited

U.S. PATENT DOCUMENTS

| | | | | |
|---|---|---|---|---|
| 3,677,019 | A | 7/1972 | Olszewski | |
| 5,768,912 | A | 6/1998 | Dubar | |
| 7,762,099 | B2 | 7/2010 | Okamoto et al. | |
| 8,020,406 | B2 * | 9/2011 | Vandor | F25J 1/0022 62/613 |
| 8,726,677 | B2 | 5/2014 | Berson et al. | |
| 2014/0245780 | A1 | 9/2014 | Wyllie et al. | |

FOREIGN PATENT DOCUMENTS

| | | | |
|---|---|---|---|
| EP | 1860389 | A1 | 11/2007 |
| JP | S58217163 | A | 12/1983 |
| JP | 60207888 | A | 10/1985 |
| JP | 01155175 | A | 6/1989 |
| JP | 02143057 | A | 6/1990 |
| JP | 0480558 | A | 3/1992 |
| JP | 05272357 | A | 10/1993 |
| JP | 06101919 | A | 4/1994 |
| JP | 09329034 | A | 12/1997 |
| JP | 2003148824 | A | 5/2003 |
| JP | 2007078211 | A | 3/2007 |
| JP | 2009036509 | A | 2/2009 |
| JP | 2009210138 | A | 9/2009 |
| WO | 2010113158 | A1 | 10/2010 |
| WO | 2013057314 | A2 | 4/2013 |

OTHER PUBLICATIONS

International Search Report issued in PCT/JP2014/057678, dated Jun. 24, 2014.
Office Action issued in JP2013-097143, dated Apr. 24, 2015.
International Preliminary Report on Patentability issued in PCT/JP2014/057678, dated Dec. 3, 2015. English translation provided.
Machine translation of the claims of JP60-207888, which was previously cited in the IDS filed on Oct. 30, 2015.
Office Action issued in European Appln. No. 14791203.4 dated May 3, 2018.
Communication pursuant to Article 94(3) EPC issued in European Application No. 14791203.4 dated Oct. 16, 2017.

* cited by examiner

[Fig.1]
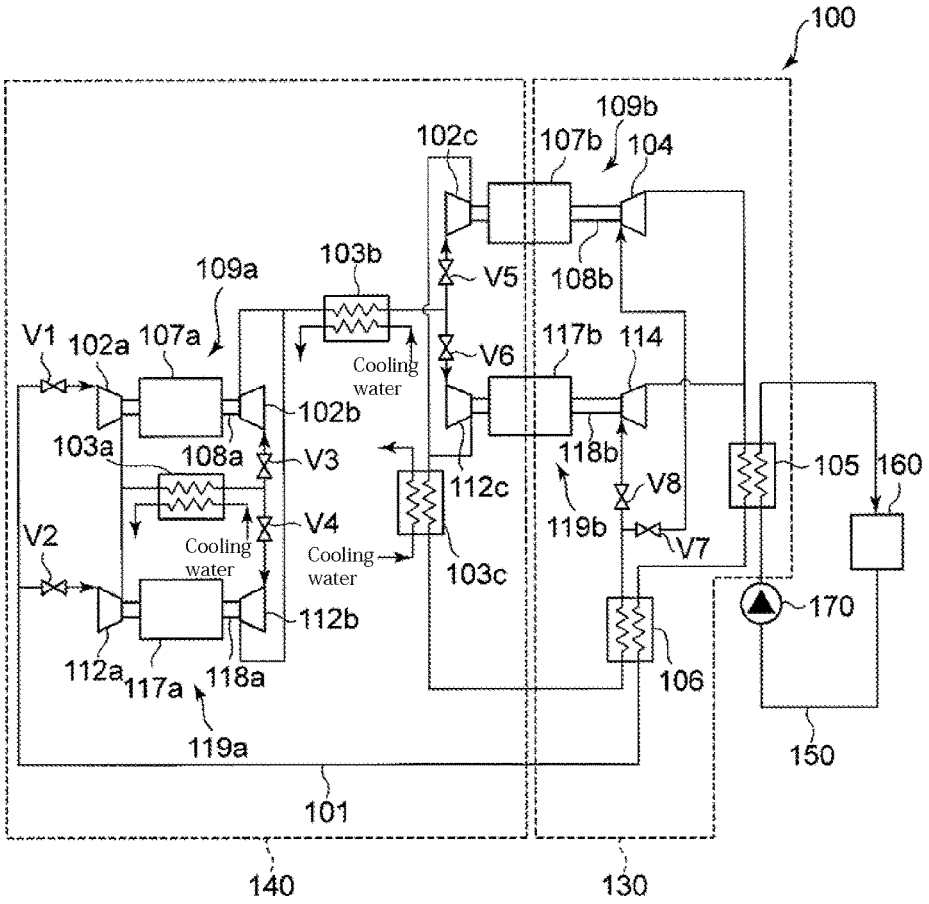
[Fig.2]
| | V1 | V2 | V3 | V4 | V5 | V6 | V7 | V8 |
|---|---|---|---|---|---|---|---|---|
| During normal operation | OPEN | CLOSE | OPEN | CLOSE | OPEN | CLOSE | OPEN | CLOSE |
| In case of failure of compressor(1st stage) | CLOSE | OPEN | CLOSE | OPEN | OPEN | CLOSE | OPEN | CLOSE |

[Fig.3]
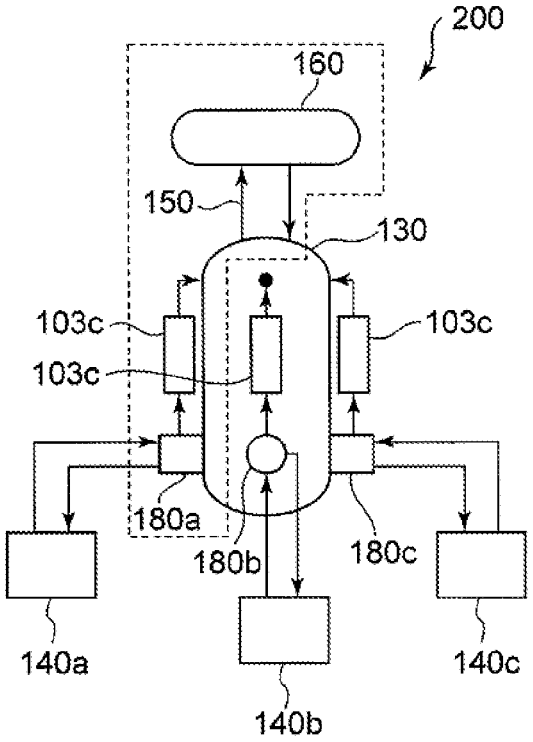
[Fig.4]
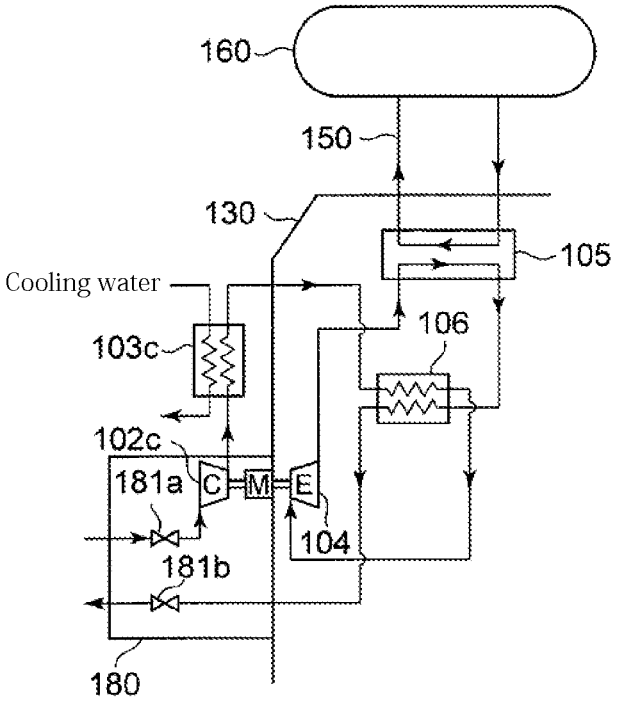

[Fig.5]
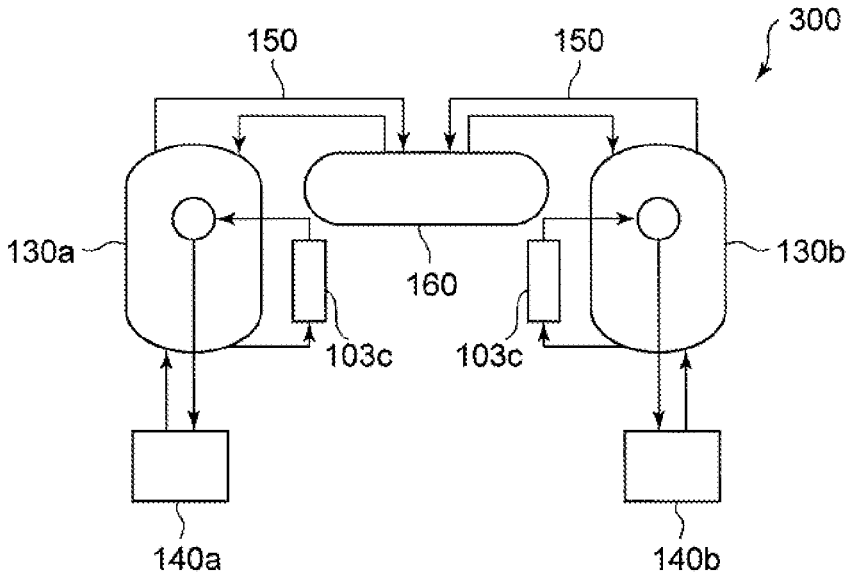

[Fig.6]
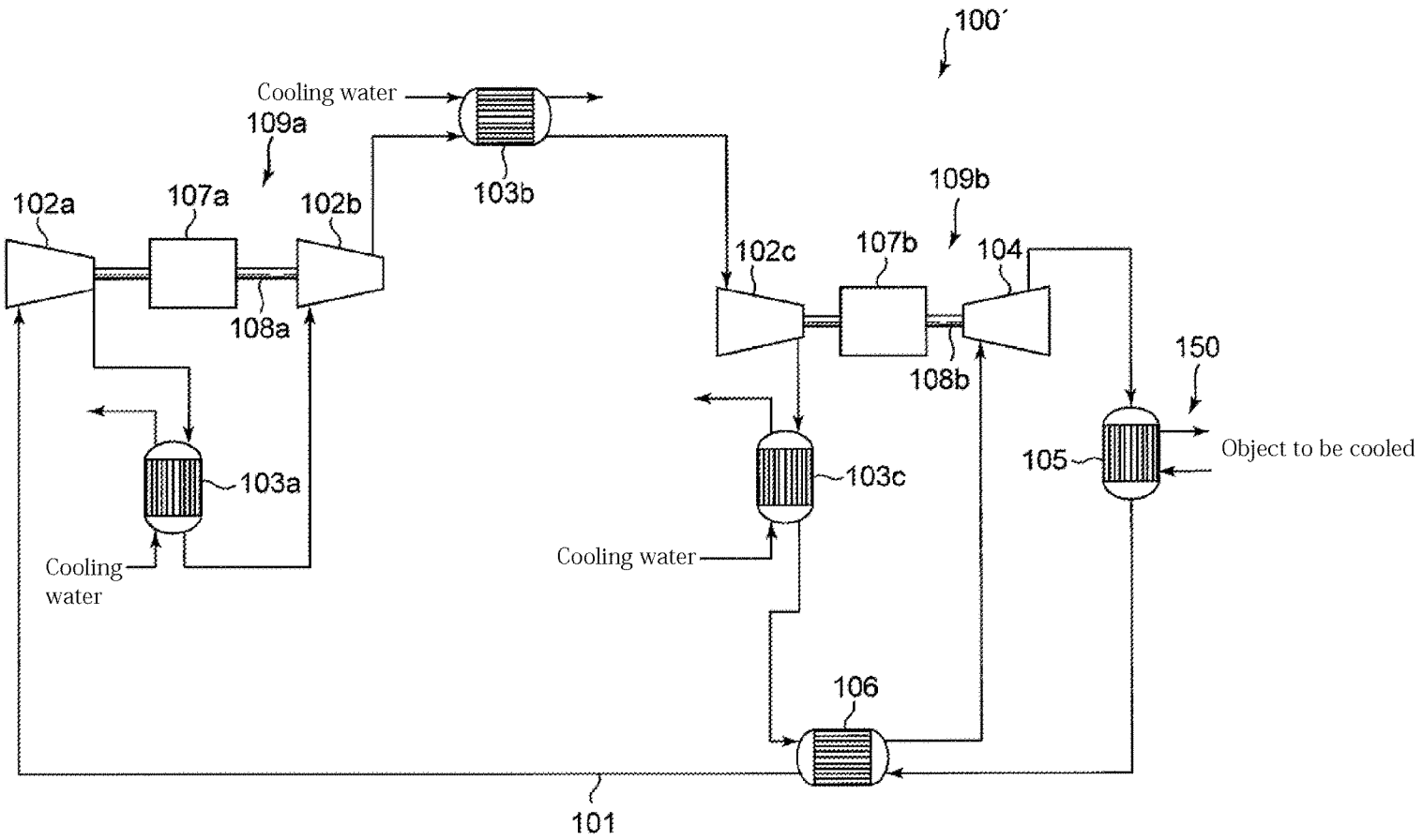

[Fig. 7(a)]
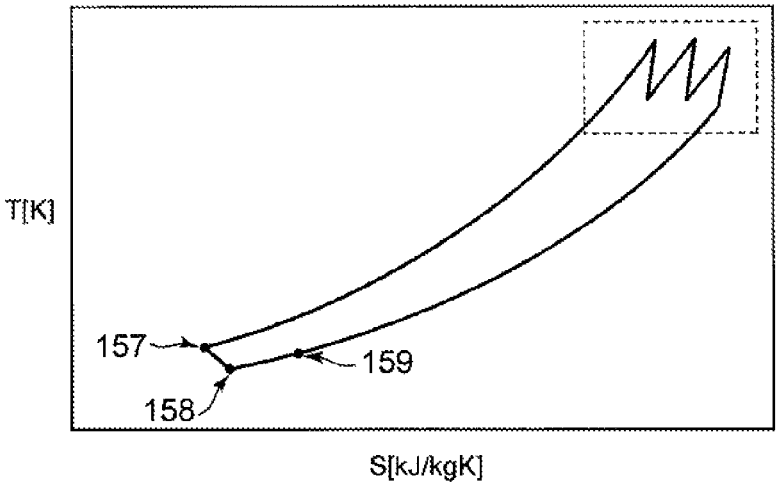
[Fig. 7(b)]
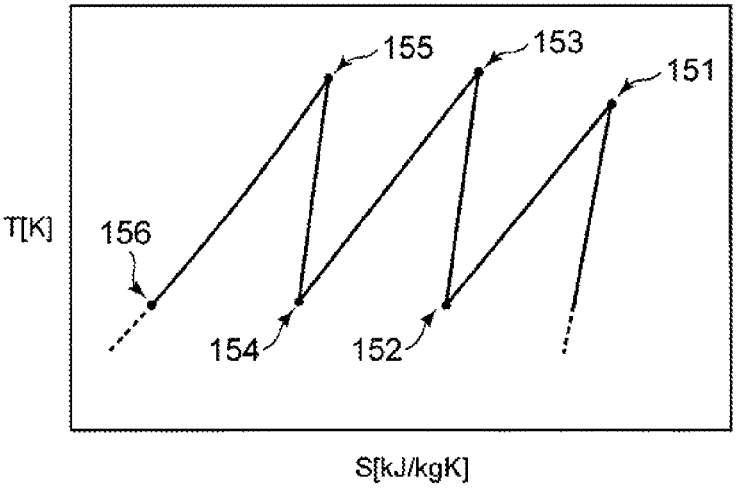

REFRIGERATION SYSTEM

TECHNICAL FIELD

The present invention relates to a refrigeration system comprising a refrigeration cycle having: a circulation path in which a refrigerant flows; and a compressor for compressing the refrigerant, a heat exchanger for cooling the refrigerant compressed by the compressor, an expansion turbine for expanding the refrigerant cooled by the heat exchanger to generate cold heat, and a cooling part for cooling an object to be cooled by the cold heat, which are provided on the circulation path in order.

BACKGROUND

A refrigeration system where a refrigerant is cooled by a refrigeration cycle using a compressor and an expansion turbine to cool an object, is widely known. Examples of such kind of refrigeration system include a refrigeration system having a plurality of compressors or expansion turbines arranged in series on a circulation path in which the refrigerant flows to compress or expand the refrigerant in multiple stages thereby to improve the cooling capacity, as disclosed in Patent Document 1 or Patent Document 2.

CITATION LIST

Patent Literature

Patent Document 1: JP 2003-148824 A
Patent Document 2: JP Hei9-329034 A

SUMMARY

Technical Problem

If the heat load due the object to be cooled is large, it is required to increase the size of the refrigeration system in order to obtain a higher refrigerating capacity. In such a case, since with regard to cold storage-type refrigerators, it is usually difficult to increase the size, countercurrent flow heat exchanger-type refrigerators using e.g. Brayton cycle are used. For example, in order to keep an extremely low temperature of a superconducting device, a large sized refrigeration system is required. Specifically, a large space to install a large-sized refrigeration system is required in order to apply a superconducting device to superconducting motors for ships or superconducting cables for power transport to be laid in urban areas, which may prevent such refrigeration system from becoming widely used.

Further, as such a refrigeration system used for superconducting devices requires stable operation, it is required to secure reliability by installing an equivalent system as a backup in order to continue the operation in case of malfunction (e.g. failure) of the refrigeration system. In such a case, there is a problem such that the total size of the refrigeration system may become further more increased.

In view of the above problems, the present invention is to provide a refrigeration system capable of ensuring excellent reliability and being efficiently installed in a limited space.

Solution to Problem

In order to accomplish the above object, the refrigeration system according to the present invention comprises a refrigeration cycle having: a circulation path in which a refrigerant flows; and at least one compressor for compressing the refrigerant, a heat exchanger for cooling the refrigerant compressed by the compressor, at least one expansion turbine for expanding the refrigerant cooled by the heat exchanger to generate cold heat, and a cooling part for cooling an object to be cooled by the cold heat, which are provided on the circulation path in order, wherein at least either the at least one compressor or the at least one expansion turbine comprises a plurality of compressors or expansion turbines which are arranged in parallel with one another with respect to the circulation path.

According to the present invention, a plurality of compressors or expansion turbines, which are rotating machines constituting the cooling cycle, are arranged in parallel with one another with respect to the circulation path in which the refrigerant flows, whereby even in case of an abnormality (e.g. failure) of one of the plurality of the rotating machines, another one of the plurality of the rotating machines can function as a backup, and it is thereby possible to continue the operation. In general, rotating machines tend to have a high risk of abnormality as compared with other components of a refrigeration system. According to the present invention, by preparing a backup only for a rotating machine having a high risk of abnormality, it is possible to increase reliability while suppressing increase in size of the whole system.

In an embodiment of the present invention, each of the plurality of compressors or each of the plurality of expansion turbines arranged in parallel with one another in the circulation path is configured to be disconnectable from the circulation path via a switching valve.

According to this embodiment, in case of an abnormality of a rotating machine such as the compressor or the expansion turbine, by opening or closing the switching valve, it is possible to switch to a backup rotating machine to continue the operation.

In an embodiment of the present invention, the at least one expansion turbine is housed together with the cooling part in at least one cold box insulated from the outside, the at least one compressor is housed in at least one compressor unit other than the at least one cold box, and the at least one compressor unit is placed at a position farther from the object to be cooled than the at least one cold box.

According to this embodiment, by placing the expansion turbine to generate a cold heat, together with the cooling part, in the cold box insulated from the outside, it is possible to suppress heat loss and to improve cooling efficiency. On the other hand, the compressor is housed in the compressor unit other than the cold box because the temperature of the refrigerant becomes relatively high in the compressor. In particular, by placing the compressor unit at a position farther from the object to be cooled than the cold box, it is possible to realize a refrigeration system which can be installed in a small space around the object to be cooled while ensuring refrigeration capacity.

In such a case, the at least one compressor unit may comprise a plurality of compressor units arranged in parallel with one another with respect to the at least one cold box via a switching valve.

According to this embodiment, a compressor unit is selectable from among the plurality of compressor units via the switching valve. Thus, even in case of an abnormality of the compressor unit used during normal operation, by switching to another compressor unit, it is possible to continue the operation to keep stable operation.

The at least one cold box may comprise a plurality of cold boxes, and the at least one compressor unit may comprise a plurality of compressor units, both of the plurality of cold boxes and the plurality of the compressor units being arranged in parallel with one another with respect to the object to be cooled.

According to this embodiment, a plurality of cold boxes and a plurality of compressor units are provided with respect to the object to be cooled, whereby it is possible to build a system having higher reliability.

In an embodiment of the present invention, the at least one compressor comprises a first compressor, a second compressor and a third compressor arranged in series on the circulation path, the first compressor is connected to an output shaft of a first electric motor together with the second compressor, and the third compressor is connected to an output shaft of a second electric motor together with one of the at least one expansion turbine.

According to this embodiment, a plurality of compressors are arranged in series on the circulation path, whereby compressing in multiple stages can be carried out. In particular, the first compressor is connected to the output shaft of the first electric motor together with the second compressor, whereby it is possible to make the structure simpler than a case where power source is provided for each compressor. In addition, the third compressor is connected to the output shaft of the second electric motor together with the expansion turbine, whereby it is possible to make the structure simple. Further, by such a configuration, power generated by the expansion turbine contributes to the compressing power of the third compressor, which may provide effectiveness.

Advantageous Effects

According to the present invention, a plurality of compressors or expansion turbines, which are rotating machines constituting the cooling cycle, are arranged in parallel with one another with respect to the circulation path in which the refrigerant flows, whereby even in case of an abnormality (e.g. failure) of one of the plurality of the rotating machines, another one of the plurality of the rotating machines can function as a backup, and it is thereby possible to continue the operation. In general, rotating machines tend to have a high risk of abnormality as compared with other components of a refrigeration system. According to the present invention, by preparing a backup only for a rotating machine having a high risk of abnormality, it is possible to increase reliability while suppressing increase in size of the whole system.

BRIEF DESCRIPTION OF DRAWINGS

FIG. 1 is a diagram illustrating a whole construction of a refrigeration system according to an embodiment of the present invention.

FIG. 2 is a table showing an operation example of switching valves in the refrigeration system illustrated in FIG. 1.

FIG. 3 is a diagram illustrating a whole construction of a refrigeration system according to a first modified example.

FIG. 4 is a detailed diagram of the area enclosed by the dashed line in FIG. 3.

FIG. 5 is a diagram illustrating a whole construction of a refrigeration system according to a second modified example.

FIG. 6 is a diagram illustrating a whole construction of a refrigeration system of a related technique.

FIGS. 7*a* and 7*b* is a T-S diagram of a Brayton cycle applied to a refrigeration system.

DETAILED DESCRIPTION

Embodiments of the present invention will now be described in detail with reference to the accompanying drawings. It is intended, however, that unless particularly specified, dimensions, materials, shapes, relative positions and the like of components described in the embodiments shall be interpreted as illustrative only and not limitative of the scope of the present invention.

(Related Technique)

Prior to description of embodiments of the present invention, a related technique as background will be described with reference to FIG. 6 and FIG. 7. FIG. 6 is a diagram illustrating a whole construction of a refrigeration system 100' of a related technique. FIGS. 7*a* and 7*b* is a T-S diagram of a Brayton cycle applied to the refrigeration system 100', where the vertical axis represents the temperature T [K], and the horizontal axis represents the entropy [KJ/kgK]. FIG. 7*b* is an enlarged view of the area enclosed by the dashed line in FIG. 7*a*.

The refrigeration system 100' comprises, on a circulation path 101 in which a refrigerant flows, a compressor 102 for compressing the refrigerant, a heat exchanger 103 for cooling the refrigerant compressed by the compressor by heat exchange with cooling water, an expansion turbine 104 for expanding the refrigerant cooled by the heat exchanger, a cooling part 105 having a heat exchanger for heat exchange between the refrigerant and an object to be cooled, and a cold heat recovering heat exchanger 106 for recovering a cold heat of the refrigerant, which are provided on the circulation path in order to form a Brayton cycle of a countercurrent flow heat exchanger-type using a refrigeration cycle of a steady circulation flow.

The object to be cooled by the refrigeration system 100' is a superconducting device (not shown) using a superconductor under a very low temperature condition. In order to maintain a very low temperature condition, liquid nitrogen as a refrigerant is permitted to circulate in the superconducting device, and in FIG. 6, only the circulation path 150 in which the liquid nitrogen circulates is shown. The circulation path 150 is configured to be able to undergo heat exchange at the cooling part 105 with the refrigerant flowing in the circulation path 101 of the refrigeration system 100'. The liquid nitrogen flowing in the circulation path 150 and having a temperature increased by the heat load of the superconducting device is thereby cooled by heat exchange with the refrigerant flowing in the circulation path 101 cooled by the refrigeration system 100'.

As the refrigerant in the circulation path 101 of the refrigeration system 100', neon may, for example, be used. However, the refrigerant is not limited thereto, and of course, other types of gas may be alternatively used depending upon the cooling temperature.

The refrigeration system 100' has, on the circulation path 101, a plurality of compressors 102*a*, 102*b*, 102*c* and heat exchangers 103*a*, 103*b*, 103*c*. The heat exchangers 103*a*, 103*b*, 103*c* are provided on a downstream side of the compressors 102*a*, 102*b*, 102*c*, respectively, and are configured to be able to cool by heat exchange with cooling water the refrigerant having a temperature increased by adiabatic compression.

The temperature of the refrigerant flowing in the circulation path 101 is increased by adiabatic compression by the compressor 102*a* provided on the uppermost stream position (see the portion 151 in FIG. 7*b*), and then the refrigerant is cooled by heat exchange by the cooling water in the heat exchanger 103*a* provided on the downstream side (see the portion 152 in FIG. 7*b*). Thereafter the temperature of the refrigerant is again increased by adiabatic compression by the compressor 102*b* (see the portion 153 in FIG. 7*b*), and then the refrigerant is cooled by heat exchange by the cooling water in the heat exchanger 103*b* provided on the downstream side (see the portion 154 in FIG. 7*b*). Further, the temperature of the refrigerant is again increased by adiabatic compression by the compressor 102*c* (see the portion 155 in FIG. 7*b*), and then the refrigerant is cooled by heat exchange by the cooling water in the heat exchanger 103*c* provided on the downstream side (see the portion 156 in FIG. 7*b*).

In the refrigeration system 100', multiple stages of adiabatic compression by compressors 102 and cooling by heat exchangers 103 are repeatedly carried out to improve the efficiency. That is, by carrying out multiple stages of repetition of adiabatic compression and cooling, the compression process of the Brayton cycle is brought closer to the ideal isothermal compression. More number of stages will make the compression process closer to the isothermal compression; however, the number of stages may be decided in view of the selection of the compression ratio due to increase in the stages, the complication of the apparatus configuration and simplicity of the operation.

The refrigerant flown through the heat exchanger 103*c* is furthermore cooled by the cold heat recovering heat exchanger 106 (see the portion 157 in FIG. 7*a*), and is subjected to adiabatic expansion by the expansion turbine 104 to generate a cold heat (see the portion 158 in FIG. 7*a*).

FIG. 6 shows an example of the refrigeration system 100' having a single expansion turbine 104; however, the refrigeration system 100' may have a plurality of expansion turbine arranged in series on the circulation path in the same way as the compressors 102.

The refrigerant exhausted from the expansion turbine 104 is subjected to heat exchange in the cooling part 105 with the liquid nitrogen flowing in the circulation path within the superconducting device as the object to be cooled to have a temperature increased by the heat load (see the portion 159 in FIG. 7*a*).

The refrigerant having a temperature increased by the cooling part 105 is introduced into the cold heat recovering heat exchanger 106, and is subjected to heat exchange with the compressed refrigerant having a high temperature flown through the heat exchanger 103*c* to recover the remaining cold heat. By using the cold heat remaining in the refrigerant after cooling the object to be cooled, the temperature of the refrigerant to be introduced into the expansion turbine can be decreased, whereby the cooling efficiency can be improved.

As described above, in the refrigeration system 100', a Brayton cycle is formed by using a plurality of rotating machines including the compressors 102 and the expansion turbine 104.

The two compressors 102*a*, 102*b* at the upper stream side are connected to the both ends of the output shaft 108*a* of the electric motor 107*a* as their common power source, respectively, to constitute a first unit 109*a*, whereby the number of parts can be reduced, and the refrigeration system can be installed in a small space. Also, the compressor 102*c* at the lower stream side and the expansion turbine 104 are connected to the both ends of the output shaft 108*b* of the electric motor 107*b* as their common power source, respectively, to constitute a second unit 109*b*, whereby he number of parts can be reduced, and the refrigeration system can be installed in a small space. In addition, the power generated by the expansion turbine 104 contributes to the compressing power of the compressor 102*c*, whereby the efficiency is improved.

Any of the compressors 102 or the expansion turbine 104 connected to either of the output shafts 108 of the common electric motors may be placed on a mount (not shown) to form the unit.

The refrigeration system 100' as described above has a problem such that it requires to have an increased size when the heat load as the object to be cooled is large, and therefore requires a broad space to be installed in. Further, when the refrigerant system 100' is needed to be operated stably, the reliability may be obtained by preparing an equivalent backup refrigeration system in order to continue the operation even in an unexpected case of e.g. failure occurrence; however, with such a method, the size of the whole system may become very large scaled (if one backup system is simply introduce, the installation space will be twice).

Such a problem may be solved by the refrigeration system as described below.

EXAMPLES

FIG. 1 is a diagram illustrating a whole construction of a refrigeration system 100 according to an embodiment of the present invention. In FIG. 1, the same elements as those of the above related technique are assigned with the same reference numerals as those of the above related technique, and the same description thereof will be omitted.

In FIG. 1, a superconducting device is indicated by an object to be cooled 160, and on the circulation path 150 for cooling the object to be cooled 160, a pump 17 for circulating liquid nitrogen is provided.

Basically, the refrigeration system 100 is capable of cooling based on the same Brayton cycle as the above refrigeration system 100'. However, the refrigeration system 100 is different from the refrigeration system 100' in that a plurality of at least a type of rotating machines, i.e. either the compressor(s) 102 or the expansion turbine(s) 104, are arranged in parallel with one another with regard to the circulation path 101.

Specifically, the first unit 109*a* comprising the compressors 102*a* and 102*b* connected to the output shaft 108*a* at the both ends, respectively, of the common electric motor 107*a*, and the unit 119*a* for backup comprising the compressors 112*a* and 112*b* connected to the output shaft 118*a* at the both ends, respectively, of the common electric motor 117*a*, are arranged in parallel with each other with respect to the circulation path 101. The first unit 109*a* and the backup unit 119*a* are selectable by operating the switching valves V1 and V2, and the switching valves are operated so that the backup unit 119*a* is selected when an abnormality of the first unit 109*a*, which is used during normal operation, is occurred.

The heat exchanger 103*a* is shared between the first unit 109*a* and the backup unit 119*a*. This is because the heat exchanger 103*a* is not a rotating machine as the compressor 102*a* or 102*b*, and thus the risk of occurrence of abnormality is lower, and the space can be reduced by sharing the heat exchanger between the units.

On the lower stream side of the heat exchanger 103*a*, switching valves V3 and V4 are provided between the first unit 109*a* and the backup unit 119*a*, and the switching valves are operated in accordance with the unit to be in use.

Further, the second unit 109*b* comprising the compressor 102*c* and the expansion turbine 104 connected to the output shaft 108*b* at the both ends, respectively, of the common electric motor 107*b*, and the unit 119*b* for backup comprising the compressor 112*c* and the expansion turbine 114 connected to the output shaft 118*b* at the both ends, respectively, of the common electric motor 117*b*, are arranged in parallel with each other with respect to the circulation path 101. The second unit 109*b* and the backup unit 119*b* are selectable by operating the switching valves V5 and V6, and the switching valves are operated so that the backup unit 119*b* is selected when an abnormality of the second unit 109*b*, which is used during normal operation, is occurred.

The heat exchanger 103*b* is shared between the second unit 109*b* and the backup unit 119*b*. This is because the heat exchanger 103*b* is not a rotating machine as the compressor 102*c* or the expansion turbine 104, and thus the risk of occurrence of abnormality is lower, and the space can be reduced by sharing the heat exchanger between the units.

On the lower stream side of the heat exchanger 103*c* and the cold heat recovering heat exchanger 106, switching valves V7 and V8 are provided between the second unit 109*b* and the backup unit 119*b*, and the switching valves are operated in accordance with the unit to be in use.

FIG. 2 is a table showing an operation example of switching valves V1 to V8 in the refrigeration system 100 illustrated in FIG. 1.

In the upper row of the table of FIG. 2, the statuses of the switching valves V1 to V8 in the case where the refrigeration system 100 is normally operated (during normal operation) are indicated. In such a situation, on the first unit 109*a* side, the switching valve V1 is opened to introduce the refrigerant to the first unit 109*a* side, and the switching valve V2 is closed to shut off the refrigerant to the backup unit 119*a* side. In this case, by opening the switching valve V3 and closing the switching valve V4, the refrigerant compressed by the compressor 102*a* is introduced to the compressor provided on the lower stream side via the heat exchanger 103*a*.

On the other hand, on the second unit 109*b* side, the switching valve V5 is opened to introduce the refrigerant to the second unit 109*b* side, and the switching valve V6 is closed to shut off the refrigerant to the backup unit 119*b* side. In this case, by opening the switching valve V7 and closing the switching valve V8, the refrigerant compressed by the compressor 102*c* is introduced to the expansion turbine 104 provided on the lower stream side via the heat exchanger 103*c* and the cold heat recovering heat exchanger 106.

In the lower row of the table of FIG. 2, the statuses of the switching valves V1 to V8 in the case where an abnormality has occurred in the compressor 102*a* or 102*b* constituting the first unit 109*a*, which is used during normal operation of the refrigeration system 100, are indicated. In such a situation, on the first unit 109*a* side, the switching valve V1 is closed to shut off the refrigerant to the first unit 109*a* side where an abnormality has occurred, and the switching valve V2 is opened to introduce the refrigerant to the backup unit 119*a* side. In this case, by closing the switching valve V3 and opening the switching valve V4, the refrigerant compressed by the compressor 112*a* is introduced to the compressor 112*b* on the lower stream side via the heat exchanger 103*a*.

On the other hand, on the second unit 109*b* side, as the compressor 102*c* and the expansion turbine 104 are normally operated, the open/close statuses of the switching valves V5 to V8 are the same as those indicated in the upper row. Also on the second unit 109*b* side, in case where an abnormality of the compressor 102*c* or the expansion turbine 104 has occurred, the switching valves V5 to V8 may be operated in the same manner (Specifically, the switching valve V5 is closed to shut off supply of the refrigerant to the second unit 109*b*, and the switching valve V6 is opened to introduce the refrigerant to the backup unit 119*b* side. Then, by closing the switching valve V7 and opening the switching valve V8, the refrigerant passed through the compressor 112*c* is introduced to the expansion turbine 114 via the heat exchanger 103*c* and the cold heat recovering heat exchanger 106.).

As described above, by operating the switching valves V1 to V8, it is possible drive the backup unit to continue the operation of the refrigeration system 100 even when an abnormality has occurred to the main unit.

Such operation of the switching valves V1 to V8 may be manually carried out when an operator has found an abnormality, or the switching valves may be automatically controlled by a controller comprising a microprocessor, etc. and having a controlling program embedded when an abnormality is detected.

In the refrigeration system 100 according to this embodiment, as illustrated in FIG. 1, the expansion turbines 104, 114, the cooling part 105, and the cold heat recovering heat exchanger 106, which are disposed at the side of the object to be cooled and in which the refrigerant having relatively low temperature flows, are accommodated in a cold box 130 capable of being insulated from the outside, to constitute one unit. The cold box 130 is configured to pretend intrusion of heat from the outside and to pretend heat loss from the expansion turbines 104, 114, the heat exchanger 105, and the cold heat recovering heat exchanger 106, which have relatively low temperature, by e.g. having a vacuum heat-insulating layer between inner and outer surfaces.

On the other hand, the compressors 102*a*, 102*b*, 102*c*, and the heat exchangers 103*a*, 103*b*, 103*c*, in which the refrigerant having relatively high temperature, are integrally provided as a compressor unit 140 outside the above cold box 130.

The cold box 130 is placed at a position closer to the object to be cooled than the compressor unit 140. It is thereby possible to supply the cold heat generated in the cold box 130 to the object to be cooled with a less loss to achieve a good refrigerating efficiency.

To put it the other way around, as the compressor unit 140 is constituted separated from the cold box 130, it can be dispersively placed at a position apart from the cold box 130. As a result, even in a case where the installation space is small around the object to be cooled, by placing only the cold box 130 in the vicinity of the object to be cooled and dispersively placing the compressor unit 140 at a position apart from the object to be cooled, it is possible to install the refrigeration system 100 even in a small installation space.

As described above, according to the refrigeration system 100 according to this embodiment, a plurality of rotating machines to perform the compression process and the expansion process are arranged in parallel with one another with respect to the circulation path 101 in which the refrigerant flows, whereby even in case of an abnormality (e.g. failure) of one of the plurality of the rotating machines, another one of the plurality of the rotating machines can function as a backup, and it is thereby possible to continue the operation. In general, rotating machines tend to have a high risk of abnormality as compared with other components of a refrigeration system. According to the embodiment, by preparing a backup only for a rotating machine having a high risk of abnormality, it is possible to increase reliability while suppressing increase in size of the whole system.

First Modified Example

Now, a configuration of the refrigeration system 200 according to a first modified example will be described with reference to FIG. 3. FIG. 3 is a diagram illustrating a whole construction of a refrigeration system 200 according to the first modified example.

In FIG. 3, the same elements as those of the above example are assigned with the same reference numerals as those of the above example, and the same description thereof will be omitted.

The refrigeration system 200 according to the first modified example is in common with the above example in that it comprises a cold box 130 and a compressor unit 140; however the refrigeration system 200 is different from the above example in that three compressor units 140*a*, 140*b*, 140*c* are provided for one cold box 130. Each of the compressor units 140 is connected to the cold box 130 via a pipe in which the refrigerant flows.

FIG. 4 is a detailed diagram of the area enclosed by the dashed line in FIG. 3. In FIG. 4, one of the three structures provided corresponding to the three compressor units shown in FIG. 3 is representatively illustrated, and the construction of the other two structures are the same.

Between each of the compressor unit 140 and the cold box 130, a box 180 is provided. In each of the box 180, switching valves 181*a* and 181*b* for switching the communication status of the refrigerant inflow/outflow lines between the compressor unit 140 and the cold box 130, the compressor 102*c* of the second compressor unit 109*b*, the electric motor 107*b* and inlet/outlet connecting pipes are provided. The refrigerant compressed by the compressors 102*a* and 102*b* of the compressor unit 140 are supplied to the box 180, and the refrigerant is additionally compressed by the compressor 102*c* and then is sent to the heat exchanger 103*c* vie a compressed gas connecting line.

The switching valves 181*a* and 181*b* are combined with the switching valves V5 and V1, respectively.

In the case where the refrigeration system 200 is operated in a normal manner, one of the three compressor units 140 is selectively driven to operate the refrigeration system 200. In the case where an abnormality has occurred to the selected compressor unit 140, the switching valves 181*a* and 181*b* in the boxes 180 are operated to switch to the other two compressor units 140 to continue the operation of the refrigeration system 200.

During normal operation of the refrigeration system 200, more than one of the three compressor units 140 may be operated in parallel at the same time. In such a case, as the load per one compressor unit 140 is reduced, the efficiency of the system may be improved; however, the number of the compressor units 140 for backup is reduced in return. Therefore the number of the operating compressor units 140 may be decided in view of the balance.

As described above, with the refrigeration system 200 according to the first modified example, as a plurality of compressor units 140 are provided, a higher reliability can be obtained. The respective compressor units 140 can be placed apart from the cold box 130, which has to be placed in the vicinity of the object to be cold, whereby it is possible to install the compressor units 140 in installation spaces apart from the cold box 130 to build the refrigeration system 200, which is capable of being installed in a small space, even in a case where a wide area required for the whole system of the refrigeration system cannot be allowed around the object to be cooled.

Second Modified Example

Now, a configuration of the refrigeration system 300 according to a second modified example will be described with reference to FIG. 5. FIG. 5 is a diagram illustrating a whole construction of a refrigeration system 300 according to the second modified example.

In FIG. 5, the same elements as those of the above example are assigned with the same reference numerals as those of the above example, and the same description thereof will be omitted.

The refrigeration system 300 according to the second modified example is in common with the above example in that it comprises a cold box 130 and a compressor unit 140; however the refrigeration system 300 is different from the above example in that it has two cold boxes 130*a*, 130*b*, and each of the two cold boxes 130 is provided with one compressor unit 140*a*, 140*b*. That is, a backup of a set including one cold box 130 and one compressor unit 140 is provided.

In this modified example, operation is switched so that, for example, during normal operation of the refrigeration system 300, the set including the cold box 130*a* and the compressor unit 140*a* are operated, and in case of occurrence of a failure, the set including the cold box 130*b* and the compressor unit 140*b* are operated, whereby a continuous operation becomes possible.

INDUSTRIAL APPLICABILITY

The present invention is applicable to a refrigeration system comprising a refrigeration cycle having a compressor for compressing the refrigerant, a heat exchanger for cooling the refrigerant compressed by the compressor, an expansion turbine for expanding the refrigerant cooled by the heat exchanger to generate cold heat, and a cooling part for cooling an object to be cooled by the cold heat, which are provided in order on a circulation path in which a refrigerant flows.

The invention claimed is:

1. A refrigeration system including a refrigeration cycle, comprising:

a circulation path in which a refrigerant flows; and at least one compressor for compressing the refrigerant, a heat exchanger for cooling the refrigerant compressed by the at least one compressor, a cold heat recovering exchanger, at least one expansion turbine for expanding the refrigerant cooled by the heat exchanger to generate cold heat, and a cooling part for cooling an object to be cooled by the cold heat provided on the circulation path in order, wherein at least either the at least one compressor or the at least one expansion turbine comprises a plurality of compressors or expansion turbines which are arranged in parallel with one another with respect to the circulation path, wherein the cold heat recovering exchanger, the at least one expansion turbine, and the cooling part are housed together in at least one cold box insulated from the outside, wherein the at least one compressor and the heat exchanger for cooling the refrigerant compressed by the at least one compressor are housed together in at least one compressor unit other than the at least one cold box, and wherein the at least one compressor unit is placed at a position farther from the object to be cooled than the at least one cold box.

2. The refrigeration system according to claim 1, wherein each of the plurality of compressors or each of the plurality of expansion turbines arranged in parallel with one another in the circulation path is configured to be disconnectable from the circulation path via a switching valve.

3. The refrigeration system according to claim 1, wherein the at least one compressor unit comprises a plurality of compressor units arranged in parallel with one another with respect to the at least one cold box via a switching valve.

4. The refrigeration system according to claim 1, wherein the at least one cold box comprises a plurality of cold boxes, and the at least one compressor unit comprises a plurality of compressor units, both of the plurality of cold boxes and the plurality of the compressor units being arranged in parallel with one another with respect to the object to be cooled.

5. The refrigeration system according to claim 1, wherein the at least one compressor comprises a first compressor, a second compressor and a third compressor arranged in series on the circulation path, wherein the first compressor is connected to an output shaft of a first electric motor together with the second compressor, and wherein the third compressor is connected to an output shaft of a second electric motor together with one of the at least one expansion turbine.

6. A super conducting system comprising:

a LN2 circulation path in which liquid nitrogen flows;

a super conducting device disposed on the LN2 circulation path and configured to be cooled by the liquid nitrogen; and a refrigeration system for cooling the liquid nitrogen, wherein the refrigeration system includes:

a circulation path in which refrigerant flows;

at least one compressor for compressing the refrigerant, a heat exchanger for cooling the refrigerant compressed by the at least one compressor, at least one expansion turbine for expanding the refrigerant cooled by the heat exchanger to generate cold heat, and a cooling part for cooling the liquid nitrogen by the cold heat, which are provided on the circulation path in order;

at least one cold box which houses the at least one expansion turbine and the heat exchanger, the at least one cold box being insulated from the outside; and a compressor unit which is disposed separately from the at least one cold box and which houses the at least one compressor, wherein the super conducting device is disposed outside the at least one cold box and the compressor unit such that the at least one compressor unit is placed at a position farther from the super conducting device than the at least one cold box.

* * * * *